US005702190A

United States Patent [19]

Shimizu et al.

[11] Patent Number: 5,702,190

[45] Date of Patent: Dec. 30, 1997

[54] DOT-MATRIX LINE PRINTER

[75] Inventors: Osamu Shimizu, Kawasaki; Kazuya Harada, Kakogawa; Shinichi Wada, Kawasaki; Tetsuya Fujimoto, Kato-gun; Takanari Inui, Kawasaki, all of Japan

[73] Assignee: Fujitsu Limited, Kawasaki, Japan

[21] Appl. No.: 684,624

[22] Filed: Jul. 22, 1996

[30] Foreign Application Priority Data

Jan. 8, 1996 [JP] Japan ..... 8-000866

[51] Int. Cl.[6] ..... B41J 19/08

[52] U.S. Cl. ..... 400/341; 400/320; 400/322; 400/353

[58] Field of Search ..... 101/93.08; 400/322, 400/320, 341, 323, 352, 353

[56] References Cited

U.S. PATENT DOCUMENTS

| | | | |
|---|---|---|---|
| 4,359,289 | 11/1982 | Barrus et al. | 400/341 |
| 4,921,365 | 5/1990 | Sanders, Jr. et al. | 400/341 |
| 5,365,839 | 11/1994 | Yoshino et al. . | |
| 5,544,964 | 8/1996 | Yoshida et al. | 400/341 |

FOREIGN PATENT DOCUMENTS

| | | |
|---|---|---|
| 62-191165 | 8/1987 | Japan . |
| 4-275164 | 9/1992 | Japan . |
| 6-40047 | 2/1994 | Japan . |
| 6-47961 | 2/1994 | Japan . |
| 6-115116 | 4/1994 | Japan . |

*Primary Examiner*—John S. Hilten

*Attorney, Agent, or Firm*—Armstrong, Westerman, Hattori, McLeland & Naughton

[57] ABSTRACT

A dot-matrix line printer includes a printing shuttle which moves reciprocally to carry out a printing operation, and a balancing shuttle which moves in a direction opposite to the direction of the movement of the printing shuttle. The balancing shuttle is partly inserted in the printing shuttle so as not to interfere with the latter upon printing and so that the center of gravity of the balancing shuttle is located as close to the center of gravity of the printing shuttle as possible.

4 Claims, 11 Drawing Sheets

DOT-MATRIX LINE PRINTER

BACKGROUND OF THE INVENTION

1. Field of the Invention

The present invention relates to a dot-matrix line printer having a printing shuttle composed of an array of printing pins (wire pins), that is laterally moved to form a predetermined dot pattern on paper to be printed using an ink ribbon, to thereby print letters or characters, etc.

2. Description of the Related Art

To increase the printing speed in a dot-matrix line printer, it has been proposed that the printing pins are driven by a release type drive mechanism and the printing shuttle is driven by a linear motor apparatus.

The printing shuttle on which a large number of printing pins a release type drive mechanism therefor, etc., are provided is inherently heavy and hence. To increase the speed of the movement of the printing shuttle, it is necessary to fundamentally redesign the internal structure of the printer and solve a heat problem.

SUMMARY OF THE INVENTION

It is an object of the present invention to provide a high-speed dot-matrix line printer in which the printing speed is remarkably increased.

To achieve the object mentioned above, according to the present invention, there is provided a dot-matrix line printer comprising a printing shuttle which reciprocally moves to carry out a printing operation, and a balancing shuttle which moves in a direction opposite to the direction of the movement of the printing shuttle, wherein the balancing shuttle is partly inserted in the printing shuttle so as not to interfere with the latter upon printing, so that the center of gravity of the balancing shuttle is located as close to the center of gravity of the printing shuttle as possible.

Preferably, the printing shuttle and the balancing shuttle are arranged to form a generally T-shape or cross-shape in cross section.

In a preferred embodiment, the printing shuttle and the balancing shuttle have at least one common shaft along and on which they move.

According to another aspect of the present invention, there is provided a dot-matrix line printer including an adjusting mechanism which adjusts a head gap between a print head of a printing shuttle and a platen, wherein the adjusting mechanism comprises a guide means to allow the platen to translate forward and backward with respect to the print head while keeping a predetermined power transmission relationship between a driven element integral with the platen and a driving element which drives the driven element.

According to still another aspect of the present invention, there is provided a dot-matrix line printer including a printing shuttle and a balancing shuttle, comprising a first cover which covers the printing shuttle and the balancing shuttle, and a small fan provided on the wall of the cover to discharge a hot air from within the cover.

Preferably, provision is made of a second cover which covers the first cover and a large fan at an air discharge port of the printer, so that the hot air discharged from the first cover can be continuously discharged from the second cover by the large fan.

BRIEF DESCRIPTION OF THE DRAWINGS

The invention will be described below in detail with reference to the accompanying drawings, in which.

DESCRIPTION OF THE PREFERRED EMBODIMENT

Different embodiments of the present invention will be discussed below.

Figure 1:
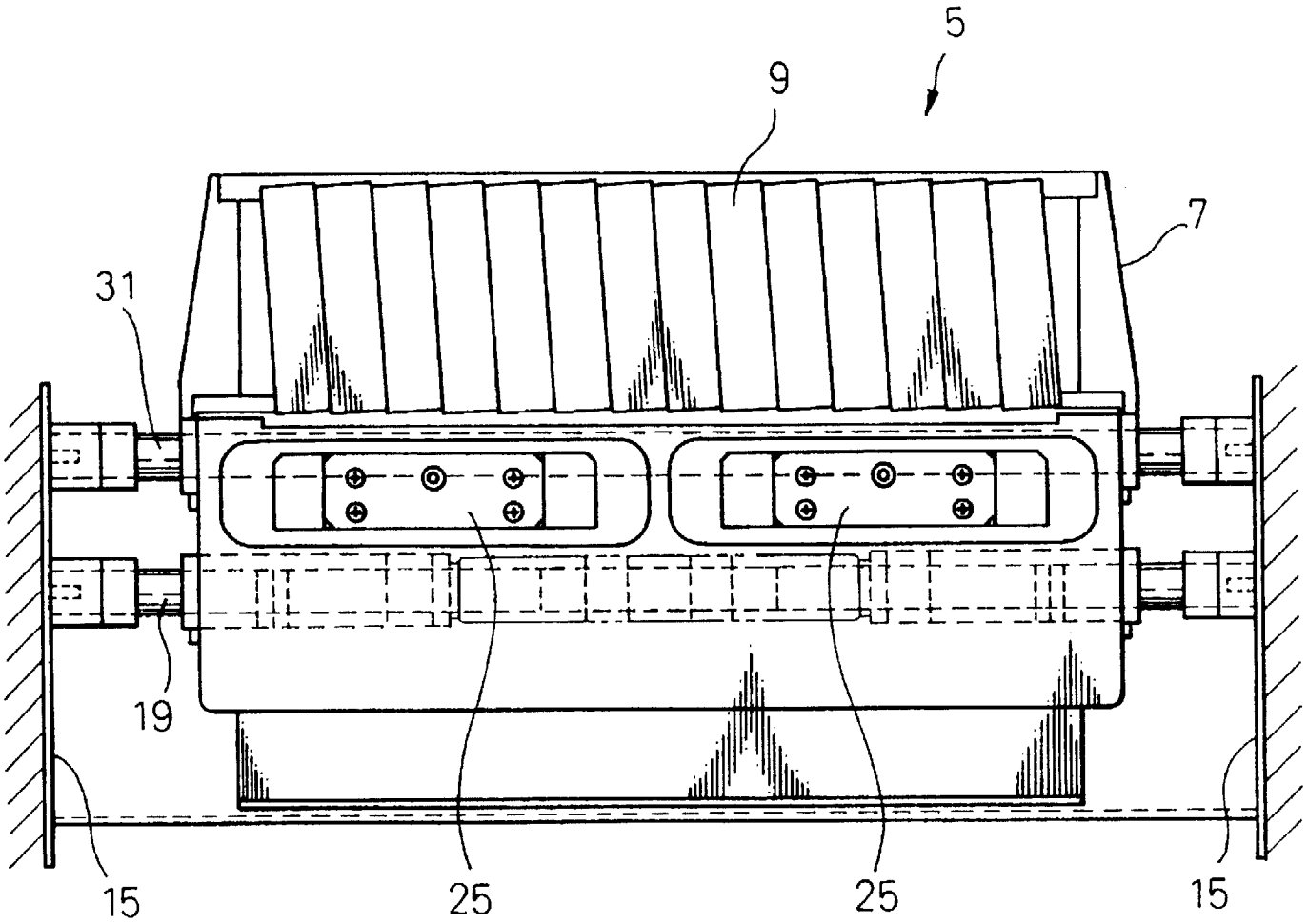
FIG. 1 is a front elevational view of a first embodiment of a shuttle mechanism according to the present invention.
Figure 2:
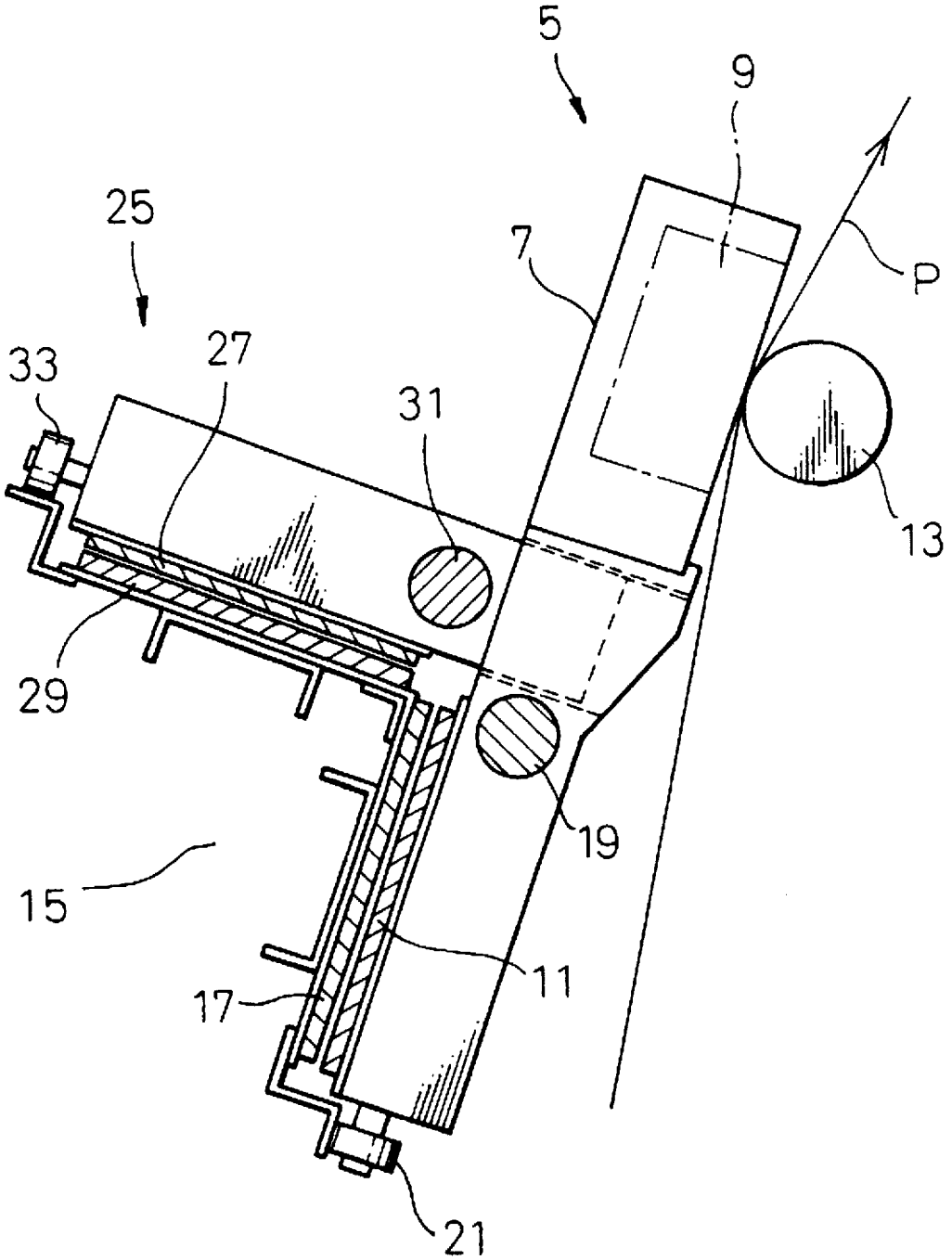
FIG. 2 is a side elevational view of the shuttle mechanism shown in FIG. 1.
Figure 3:
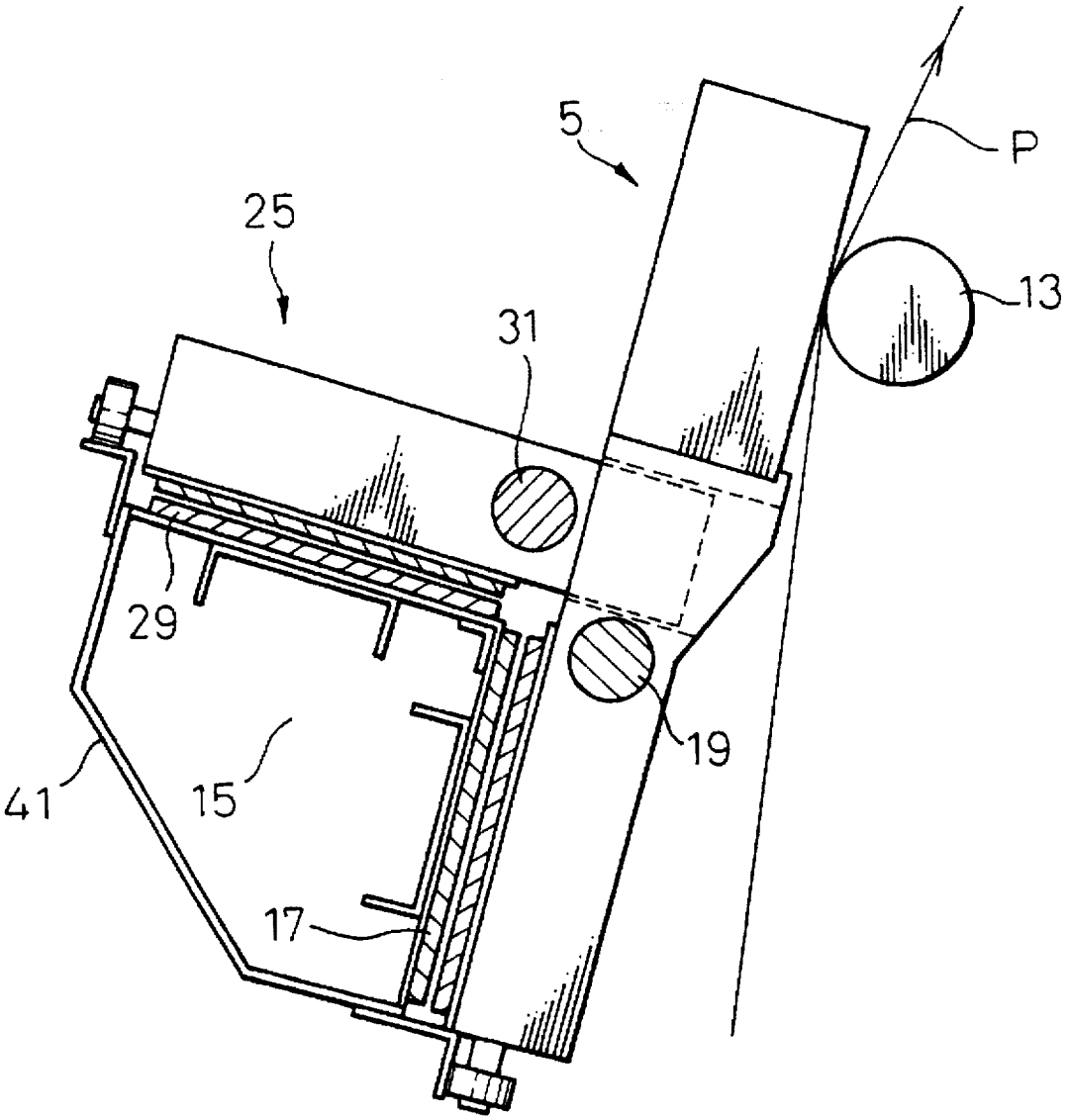
FIG. 3 is a view similar to FIG. 2, showing a modification of the first embodiment shown in FIG. 1.

(I) First, reference is made to an improvement of a shuttle mechanism of a dot-matrix line printer according to the present invention.

a) Looking at FIGS. 1 and 2, a dot-matrix line printer (only main elements thereof are illustrated in the drawings) includes a printing shuttle 5 which is composed of a shuttle frame 7, printing units 9 provided on the upper portion of the shuttle frame 7, and a permanent magnet 11 attached to the lower side surface of the shuttle frame 7. The printing units 9 are each provided with a large number of printing pins, and a release type drive mechanism which drives the printing pins in the direction toward a platen 13 in the form of a cylindrical roll, located on the rear side of a paper P to be printed to thereby execute the printing operation.

The surface of a body frame 15 opposed to the lower side surface of the shuttle frame 7 (i.e., the permanent magnet 11 provided thereon) is provided with a large number of electromagnetic coils 17. The permanent magnet 11 of the printing shuttle 5 (movable side) and the electromagnetic coils 17 of the body frame 15 (stationary side) constitute a linear motor to reciprocally move the printing shuttle 5 along a shuttle shaft 19 which extends through the shuttle frame 7 substantially at the center thereof. The shuttle frame 7 is provided on the lower end thereof with rotatable rollers 21 which roll on the body frame to keep a constant distance between the permanent magnet 11 and the electromagnetic coils 17.

A balancing shuttle 25 as a counter weight mass is provided to move in a direction opposite the movement of the printing shuttle 5 to eliminate or cancel the vibration which would be otherwise produced by the movement of the printing shuttle. The balancing shuttle 25 is inserted at its one end in the printing shuttle 5 so as not to physically interfere with the same, so that the balancing shuttle 25 and the printing shuttle 5 form a generally T-shape in cross section. The balancing shuttle 25 is provided on the lower surface thereof with a permanent magnet 27, and the body frame is provided on the surface opposed to the permanent magnet 27, with a large number of electromagnetic coils 29. The permanent magnet 27 (movable side) and the electromagnetic coils 29 (stationary side) constitute a linear motor apparatus to reciprocally move the balancing shuttle 25 along a stay shaft 31 which extends through the balancing shuttle 25.

The balancing shuttle 25 is provided on the other end thereof with rotatable rollers 33 which roll on the body frame to keep constant a distance between the permanent magnet 27 and the electromagnetic coils 29.

Figure 8:
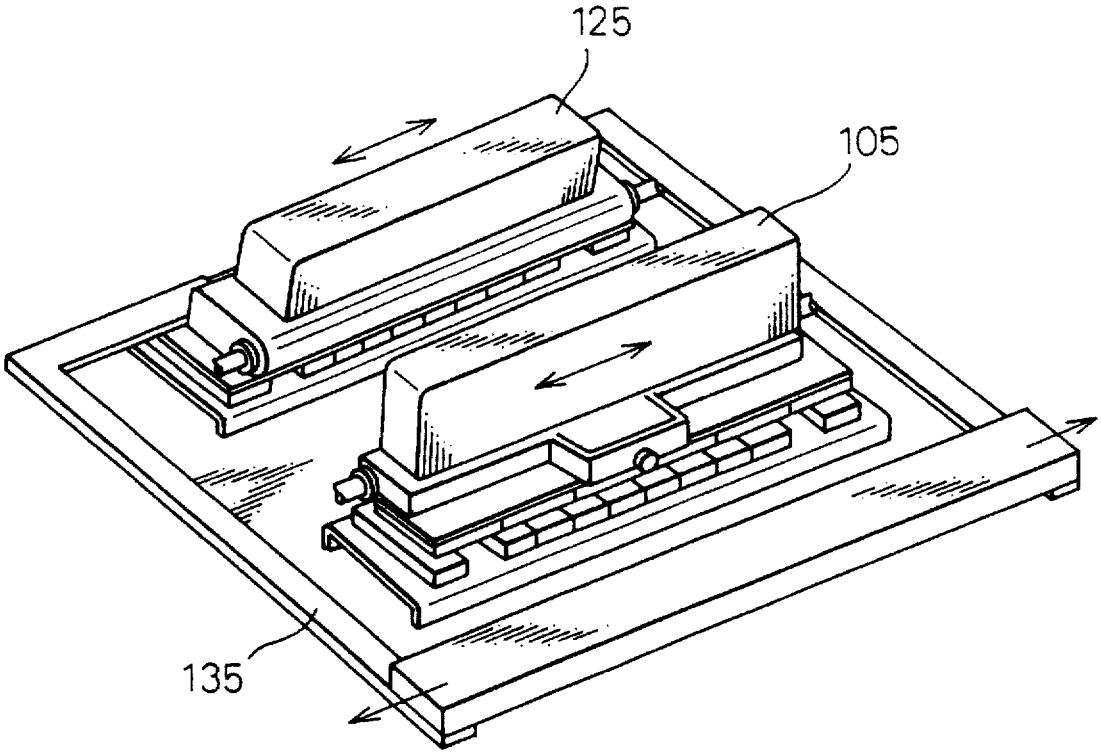
FIG. 8 is a perspective view of the main components of a known shuttle mechanism.
Figure 9:
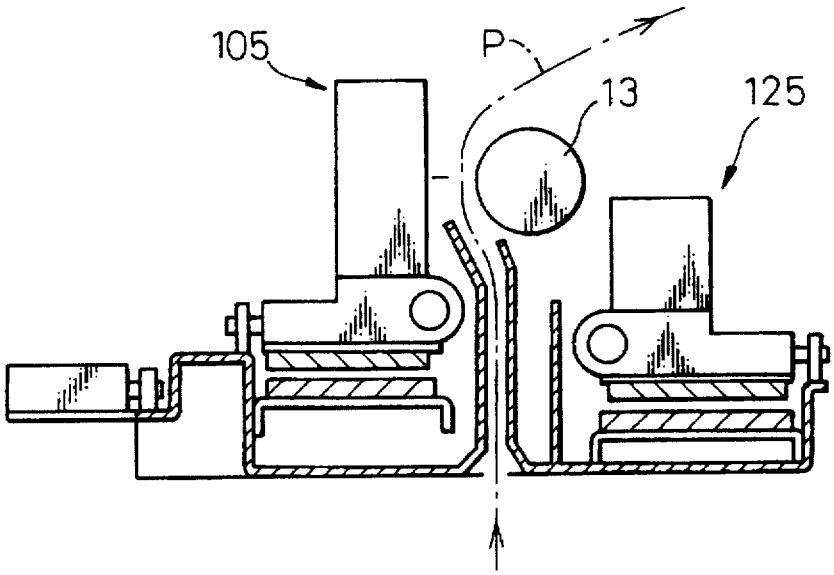
FIG. 9 is a partially sectioned side elevational view of the known shuttle mechanism shown in FIG. 8.

In the first embodiment of a shuttle mechanism as constructed above, it is possible to locate the center of gravity of the balancing shuttle 25 considerably close to the center of gravity of the printing shuttle 5. For comparison sake, the prior art will be discussed below referring to FIGS. 8 and 9. In FIGS. 8 and 9, the paper P to be printed (travelling passage thereof) and a paper feeding mechanism are provided between the printing shuttle 105 and the balancing shuttle 125, and hence, it is difficult to locate the centers of gravity of the printing shuttle 105 and the balancing shuttle 125 close to each other. To minimize the distance between the centers of gravity, a frame 135 which substantially surrounds the printing shuttle 105 is secured to the balancing shuttle 125, so that the center of the resultant gravity of the balancing shuttle 125 (and the frame 135) comes closer to the center of gravity of the printing shuttle 105. However, the large and heavy frame 135 which is laterally moved together with the balancing shuttle 125 makes the whole structure of the apparatus heavy and complicated. Accordingly, the solution relying upon the provision of the heavy frame 135 is neither reasonable nor economical. In contrast with the prior art, in the present invention, the center of gravity of the printing shuttle can be located remarkably close to the center of gravity of the balancing shuttle by a simple arrangement. Thus, the rotation moments of the printing shuttle and the balancing shuttle can be well canceled to thereby eliminate or reduce the vibration of the entire apparatus, resulting in a high quality print. Consequently, a dramatic increase in speed of the dot-matrix line printer can be achieved.

Figure 4:
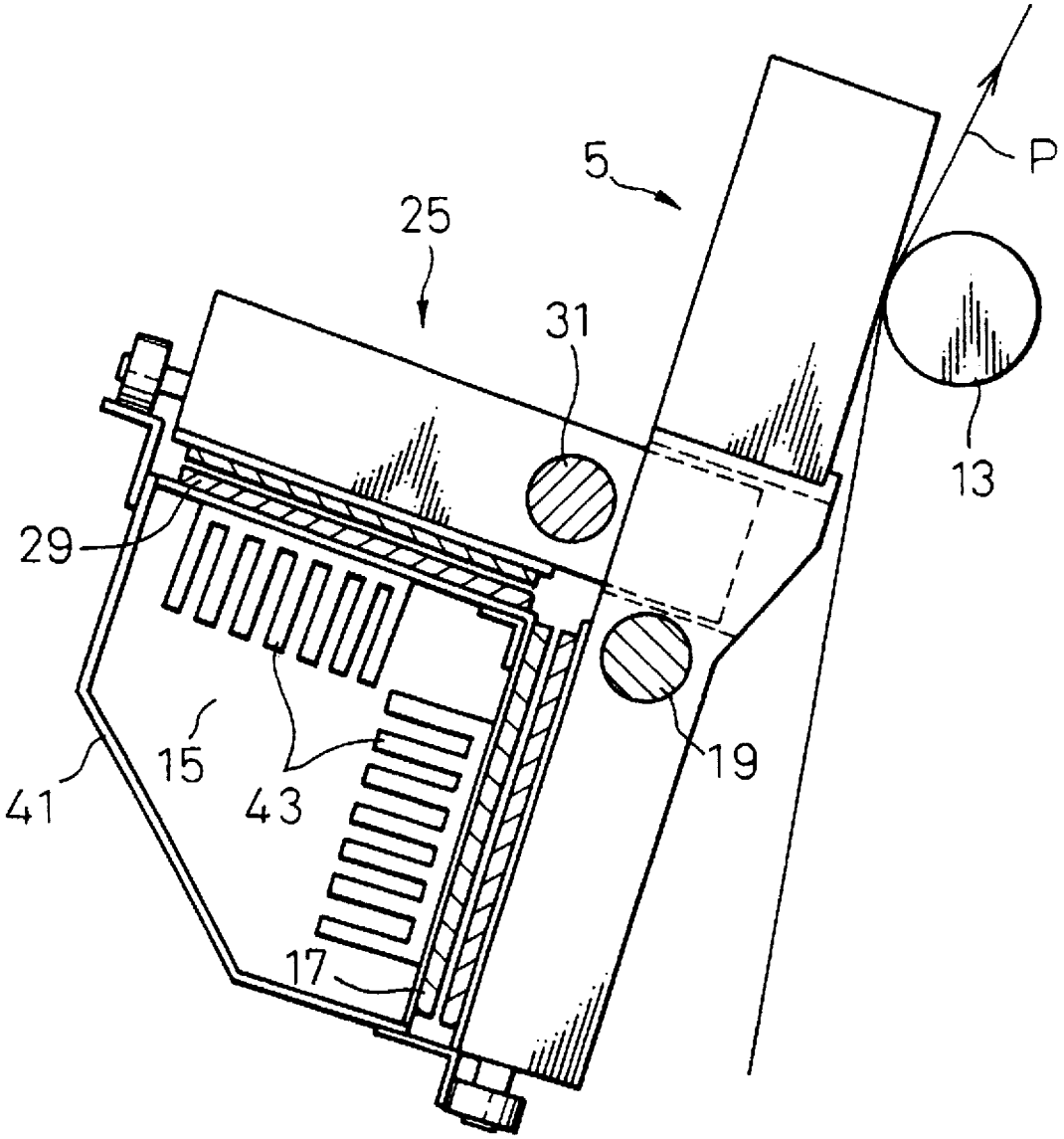
FIG. 4 is a view similar to FIG. 3, showing another modification of the first embodiment shown in FIG. 1.
Figure 5:
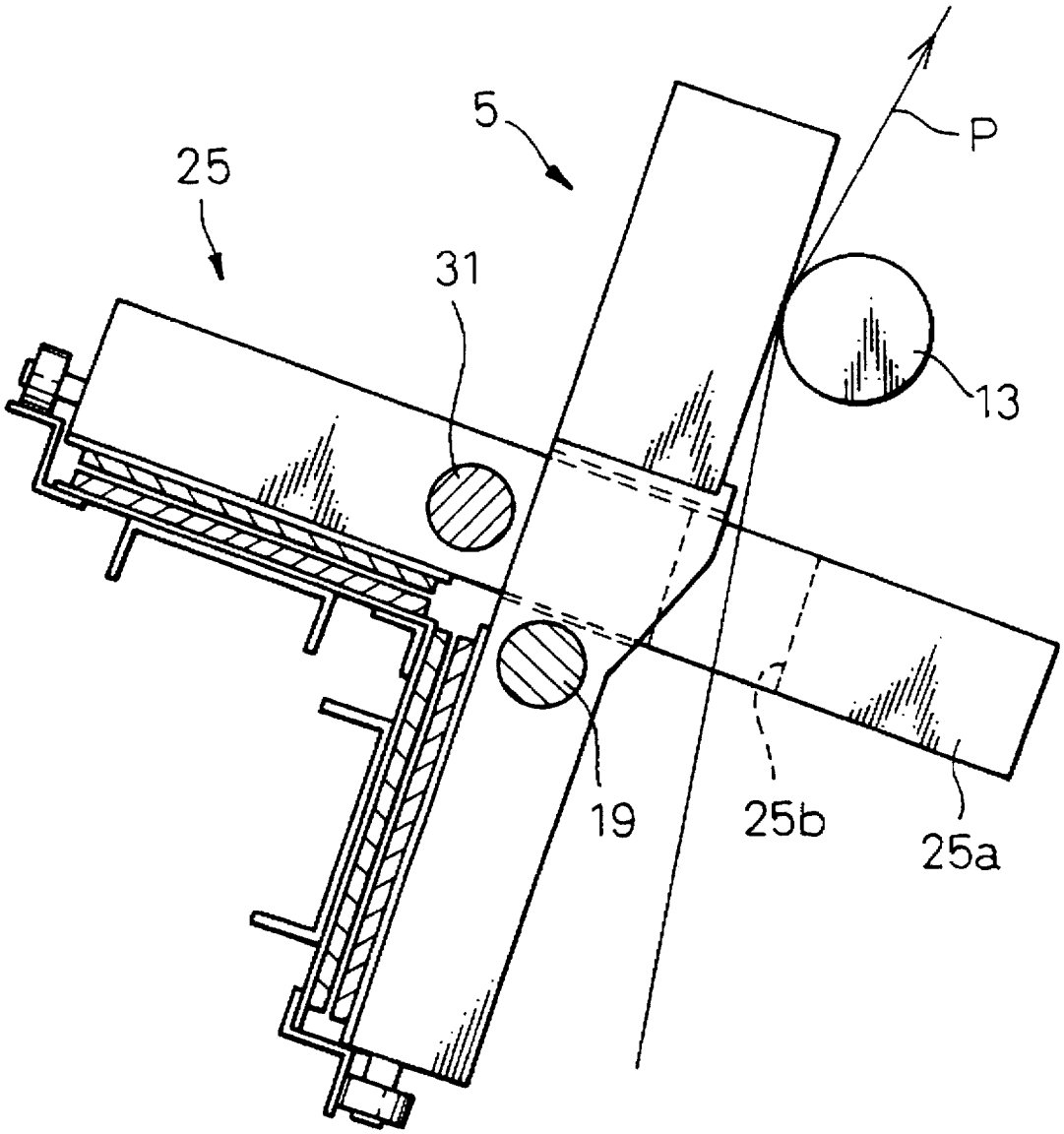
FIG. 5 is a view similar to FIG. 3, showing yet another modification of the first embodiment shown in FIG. 1.

It is possible to provide a duct 41 on the lower portion of the body frame to cover the electromagnetic coils 17 and 29. The duct is provided on its inlet and/or outlet portion with a fan to effectively cool the electromagnetic coils 17 and 29 which generate heat. The cooling of the electromagnetic coils 17 and 29 contributes to a fast movement of the printing shuttle 5 and the balancing shuttle 25, thus leading to a realization of a high speed dot-matrix line printer. Alternatively, it is also possible to provide heat radiating fins 43 in the vicinity of the electromagnetic coils 17 and 29 to cool the same more effectively, as may be seen in FIG. 4. Moreover, as shown in FIG. 5, it is possible to arrange the balancing shuttle 25 such that its one end extends perpendicularly through the printing shuttle 5 by a predetermined length of protrusion, so that the balancing shuttle 25 and the printing shuttle 5 generally exhibits a cross-shape in cross section. The protruding end **25*a* of the balancing shuttle 25 is provided with a through hole 25*b* through which the paper P can pass without interference. With this arrangement, the centers of gravity of the shuttles 5 and 25** can be located at the substantially same position, thus resulting in no or little vibration of the apparatus.

Figure 6:
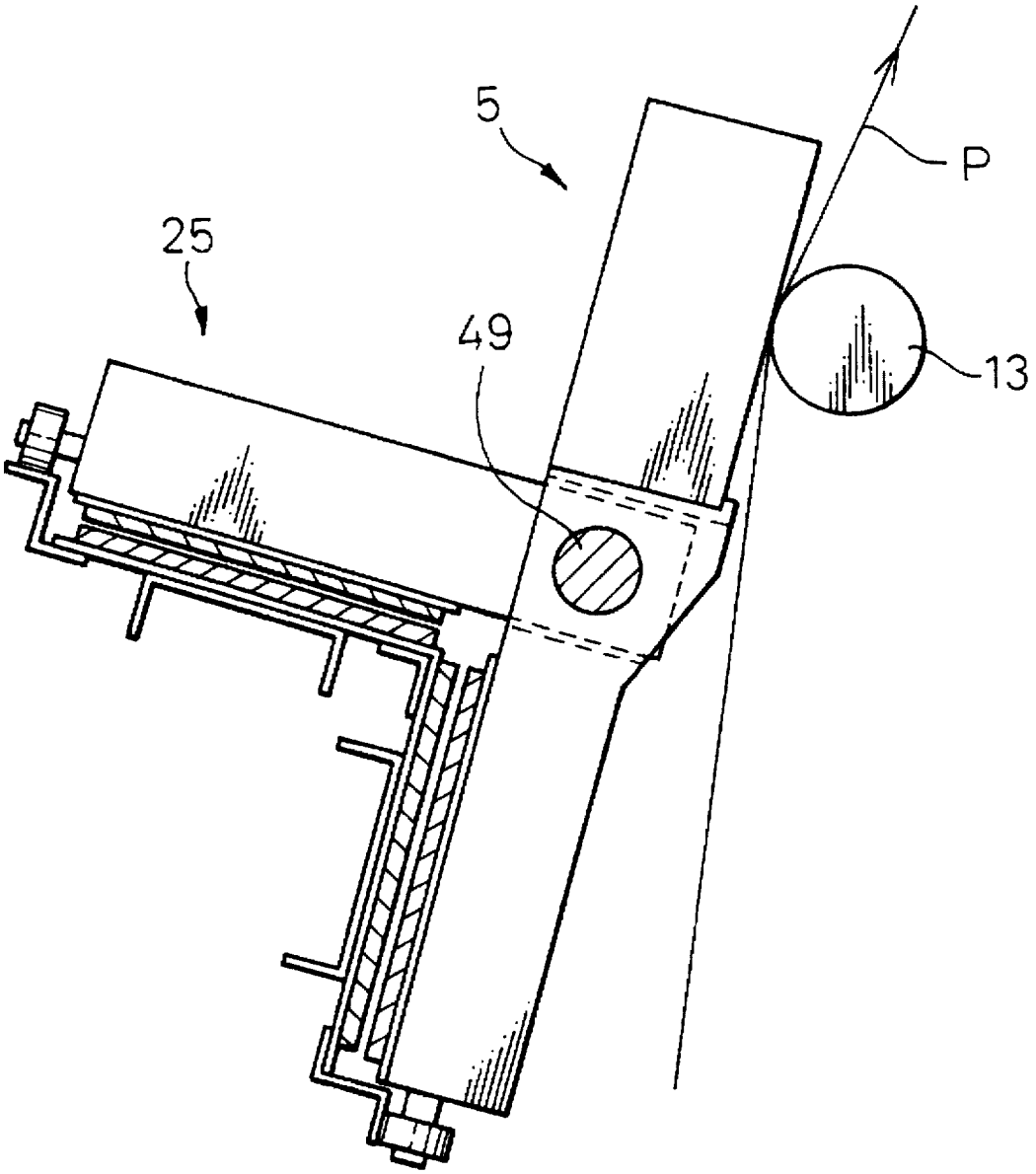
FIG. 6 is a side elevational view of a second embodiment of a shuttle mechanism according to the present invention.
Figure 7:
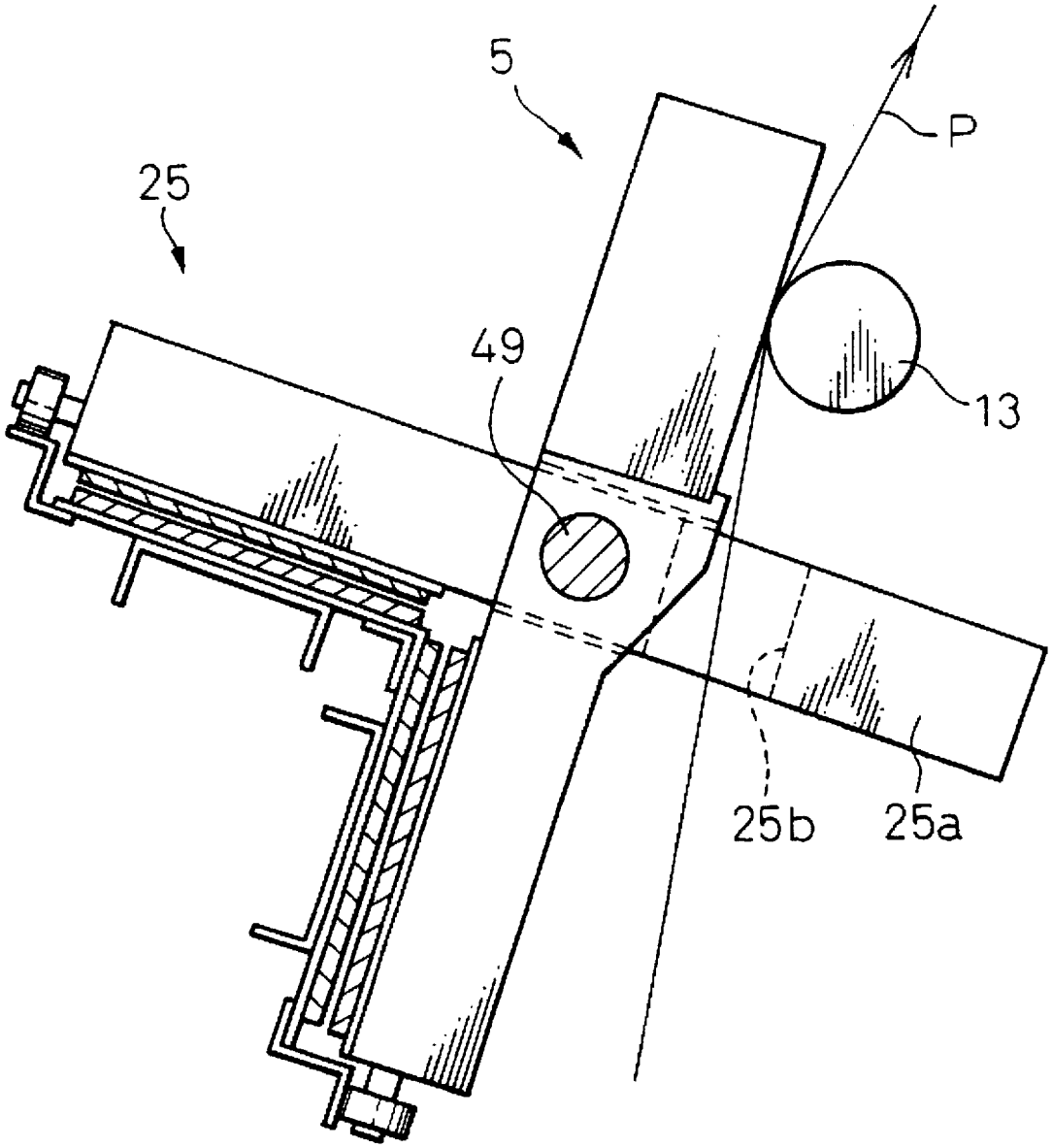
FIG. 7 is a view similar to FIG. 6, showing a modification of the second embodiment shown in FIG. 6.

(b) A second embodiment of a shuttle mechanism will be discussed below referring to FIG. 6. In FIG. 6, the elements corresponding to those in the first embodiment (FIG. 2) are designated with like reference numerals. In summary, in the second embodiment, the shuttle shaft of the printing shuttle and the stay shaft of the balancing shuttle are identical (common). In the second embodiment, since the center of gravity of the printing shuttle 5 and the center of gravity of the balancing shuttle 25 are located close to each other and the shuttle shaft of the printing shuttle 5 is identical to the stay shaft of the balancing shuttle 25, the rotation moments acting on the shuttles 5 and 25 are canceled, so that the vibration can be effectively attenuated. As can be seen in FIG. 7, and similarly to the arrangement shown in FIG. 5, one end of the balancing shuttle 25 extends perpendicularly through the printing shuttle 5 by a predetermined length of protrusion, so that the balancing shuttle 25 and the printing shuttle 5 exhibit a generally cross-shape in cross section. The protruding end **25*a* of the balancing shuttle 25 is provided with a through hole 25*b* through which the paper P to be printed can pass without interference. With this arrangement, the centers of gravity of the balancing and printing shuttles 25 and 5** can be located at the substantially same position, thus resulting in no or little vibration of the apparatus.

(II) The following discussion will be addressed to the improvement of a head gap adjusting mechanism.

In a dot-matrix line printer, the gap between the printing units (print heads) 9 and the platen (roll) 13 must be adjusted depending on the thickness of the paper P to be used. Moreover, if the printing operations are repeated with the platen 13 being at a fixed position, partial or local wear of the platen 13 would occur, thus resulting in a breakage of the wiring pins. To avoid this, it is necessary to appropriately rotate the platen to change the angular position of the platen. In conventional head gap adjusting mechanisms, the mechanical structure is complex and heavy and requires a long time for adjustment. In addition to the foregoing, it is very difficult to adjust the head gap with high precision in conventional mechanisms.

In the improvement of the head gap adjusting mechanism according to the present invention, the basic concept resides in a guide means to allow the platen 13 to translate along a predetermined arced locus whose center of curvature is located on the drive shaft axis of the motor 51 which drives the platen 13, while keeping the power transmission relationship between the platen 13 and the motor 51. Consequently, the gap adjustment can be carried out by moving the platen solely, and hence not only can the apparatus be simplified and lightened, but also the gap adjustment can be easily, quickly, and precisely executed. Two aspects of the improvement will be discussed below.

Figure 10:
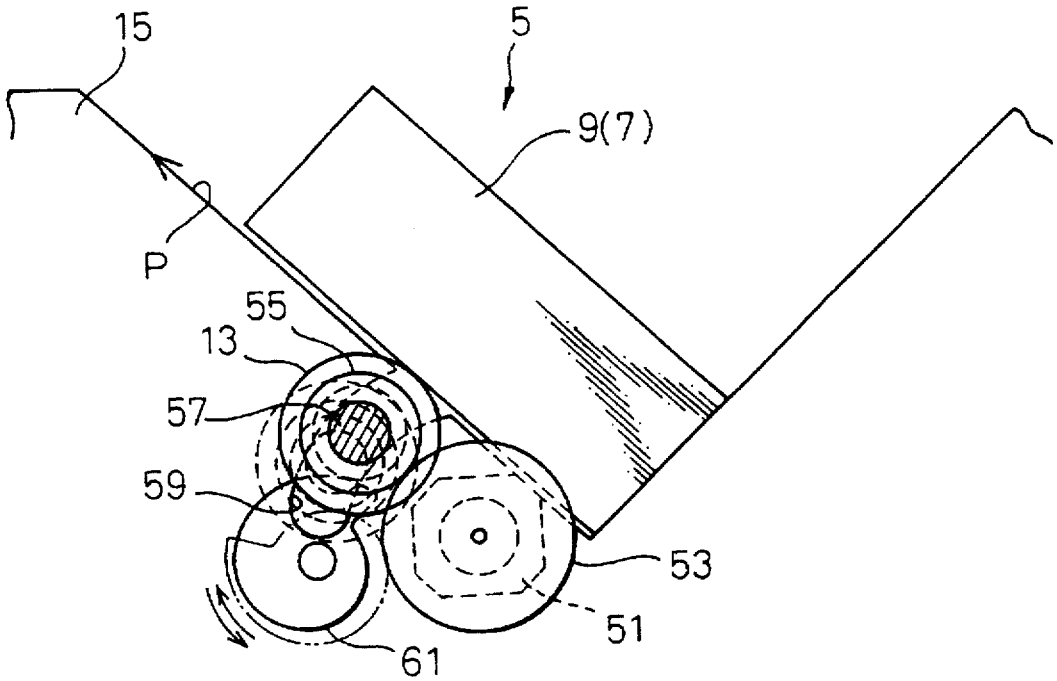
FIG. 10 is a side elevational view of a first embodiment of a head gap adjusting mechanism according to the present invention.

(a) In the first aspect shown in FIG. 10, the motor 51 which drives the platen is made of, for example, a stepping motor attached to the body frame 15 and having a drive shaft to which a motor gear 53 is secured. The motor gear 53 is in mesh with a platen gear 55 provided on one side of the platen 55. The body frame 15 is provided on the portions thereof located on opposite sides of the platen 13, with arced guide grooves 59 in which the platen 13 (opposed shaft portions 57 thereof) is guided along a predetermined arced locus whose center of curvature is located on the axis of the drive shaft of the motor 51.

There are eccentric cams 61 in back of the platen 13 (away from the printing unit 9) to move the platen 13 and the platen gear 55 forward and backward (close to and away from the printing unit). Upon adjustment of the head gap between the printing units (print heads) 9 and the platen 13, the eccentric cams 61 are rotated by the motor 51 to press the platen 13 against the printing units 9, and thereafter, the motor 51 is reversed to rotate the eccentric cams 61 in the reverse direction to thereby move the platen located at the press-contact position, away from the printing units 9. In this way, a predetermined gap can be easily and precisely established between the platen 13 and the printing units 9.

Figure 11:
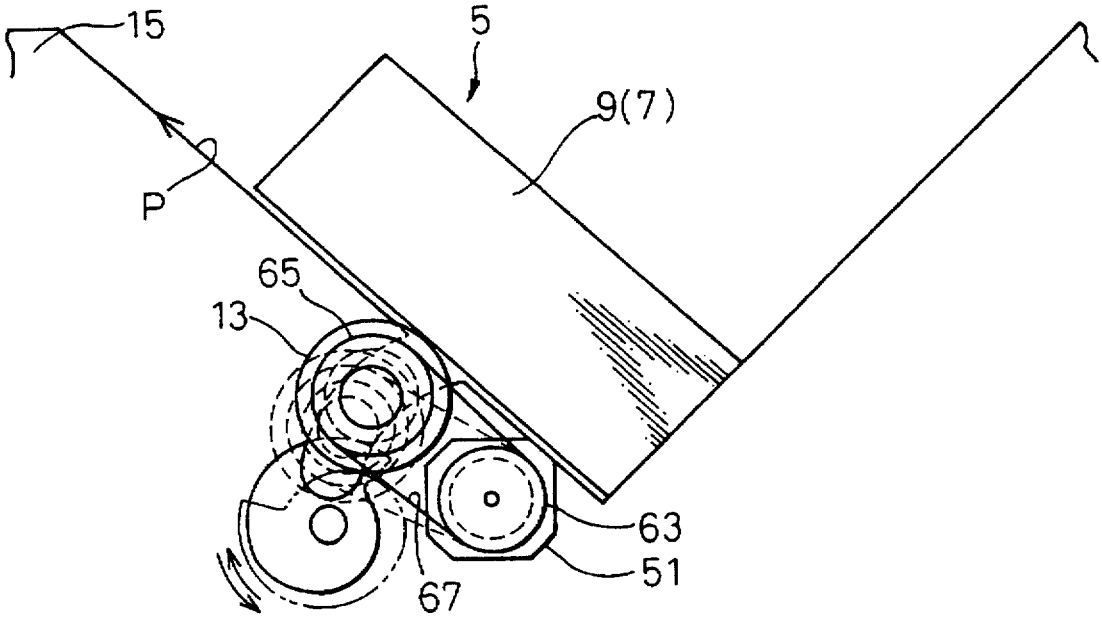
FIG. 11 is a side elevational view of a second embodiment of a head gap adjusting mechanism according to the present invention.

(b) In a second aspect of the invention shown in FIG. 11, the motor gear 53 and the platen gear 55 shown in FIG. 10 are replaced with a motor pulley 63 and a platen pulley 65, respectively. The motor pulley 63 and the platen pulley 65 are connected by a pulley belt 67 wound thereabout. Also in this aspect, a predetermined gap can be easily and precisely established between the platen and the printing unit.

(III) The improvement to effectively cool the printing shuttle (print head portion) of a dot-matrix line printer, according to the present invention will be discussed below.

In the conventional cooling system, a cooling fan is provided in front of the apparatus, wherein the air is sent onto the printing unit by the cooling fan to change the direction of the air flow toward the print heads. However, in this cooling system, the air from the fan may flow in different directions before reaching the print heads, so that an in sufficient amount of air is supplied to the print heads which, accordingly, cannot be cooled sufficiently. Consequently, it takes a long time to complete the printing operation, since it is impossible to actuate many printing wires at one time because an increased amount of heat would be generated, or the service life of the print head portion would be reduced.

According to the improvement of the present invention, the air can be effectively and concentrically sent into the apparatus to appropriately cool the printing shuttle (print head portion) to thereby eliminate the above-mentioned problem in the prior art. Two embodiments of the invention to improve the cooling efficiency will be described below.

Figure 12:
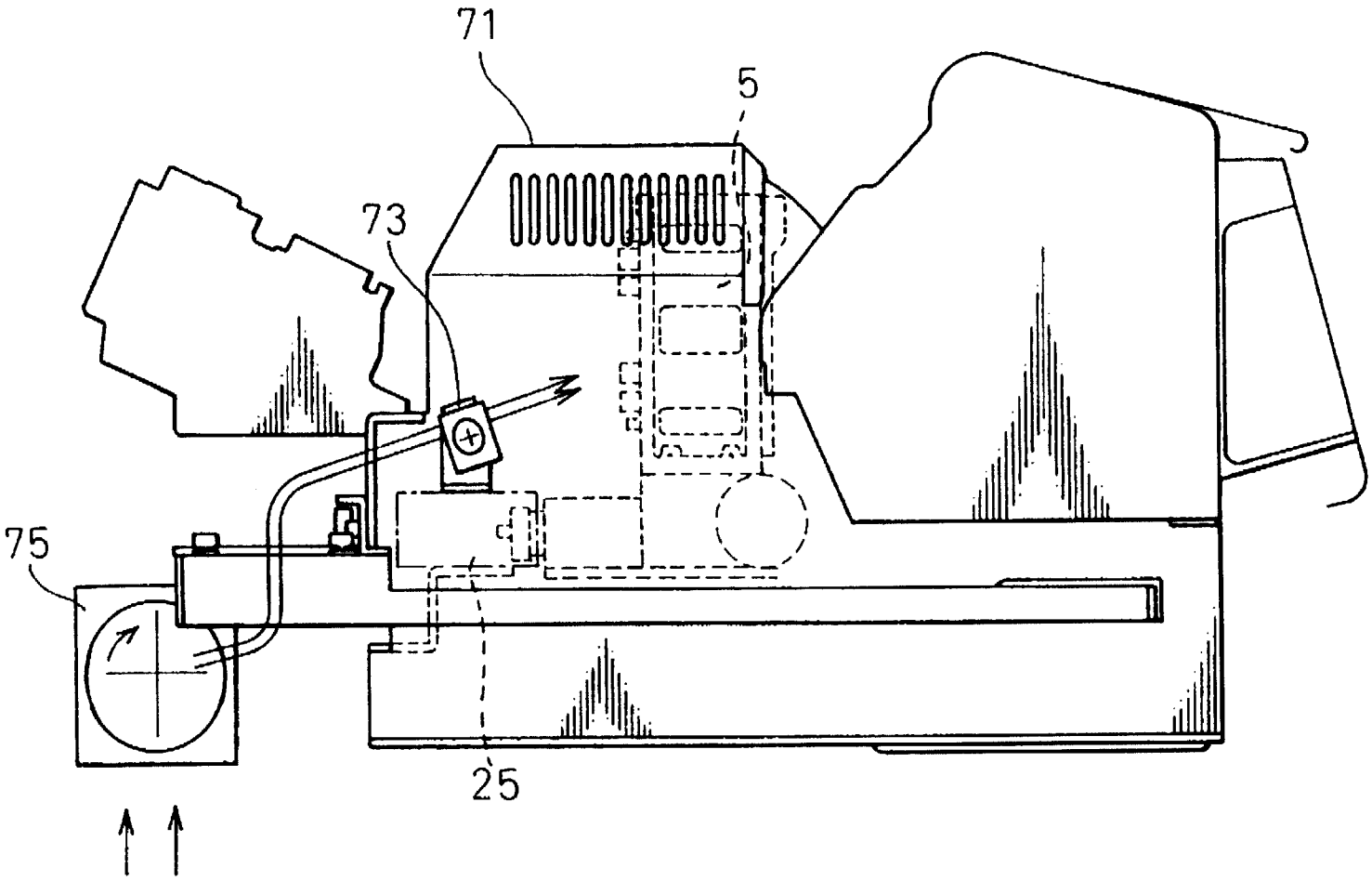
FIG. 12 is a side elevational view of a first embodiment of a print head cooling mechanism according to the present invention; and, FIG. 13 is a side elevational view of a second embodiment of a print head cooling mechanism according to the present invention.

(a) In a first embodiment shown in FIG. 12, the printing shuttle 5 and the balancing shuttle 25 are enclosed by a cover 71 which is in turn covered by an outer body cover which is pivoted to the apparatus body to open and close the upper portion of the apparatus body. A small air-supply fan 73 is provided on the balancing shuttle 25. The small fan 73 itself advantageously constitutes a counter weight mass together with the balancing shuttle 25. Owing to the symmetrical movement of the printing shuttle 5 and the balancing shuttle 25 in opposite directions, the external cold air introduced by a large fan 75 provided underneath the body frame can be distributed substantially uniformly toward the printing shuttle (print head portion) 5. Hence, the latter, which produces a large amount of heat, can be effectively cooled. Alternatively, it is possible to provide a small fan on an upper portion of the cover 71 at an appropriate position inside or outside the cover to discharge the hot air within the cover 71 (particularly the hot air in the vicinity of the print head portion), in addition to or instead of the arrangement shown in FIG. 12.

Figure 13:
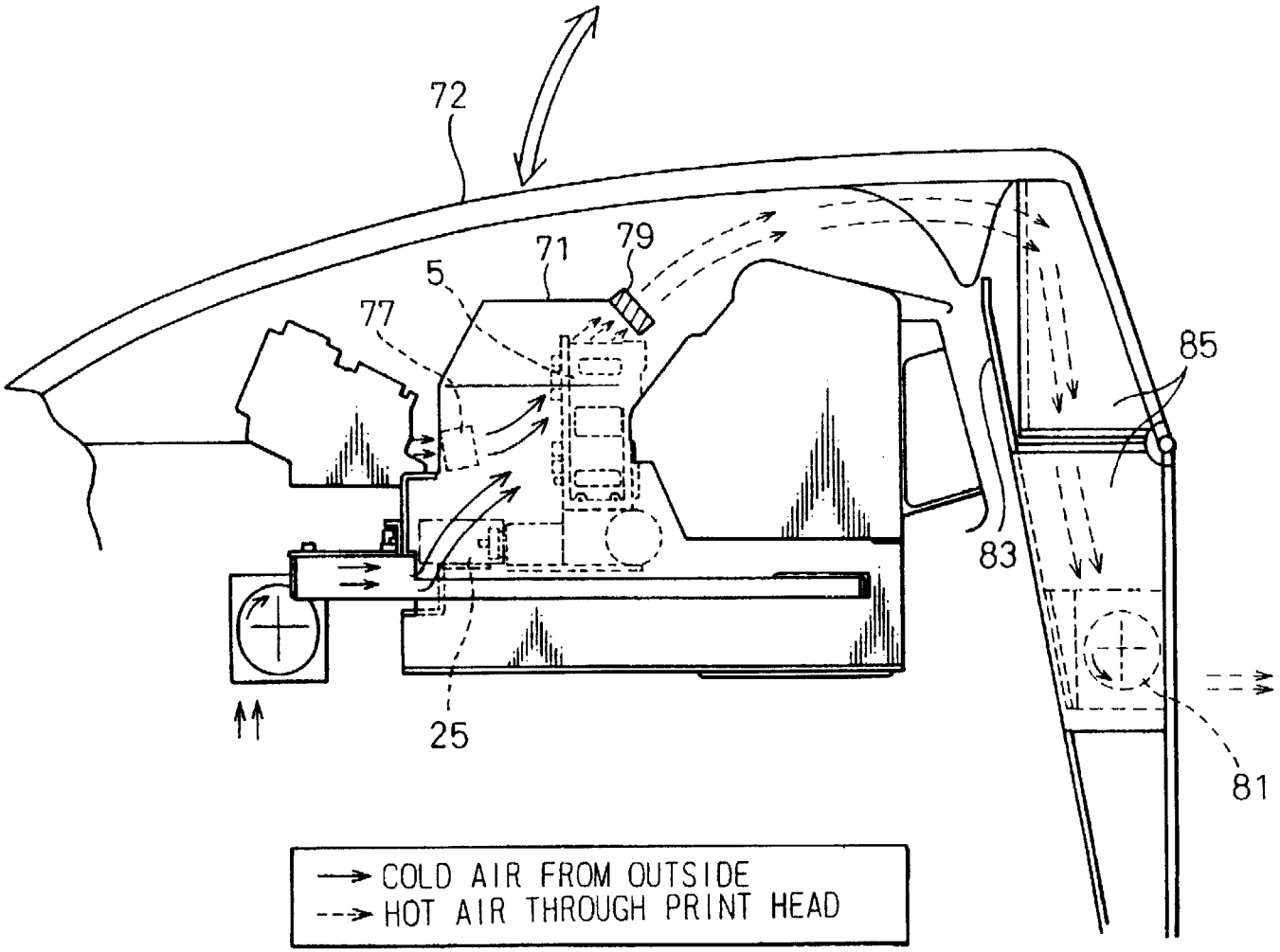

(b) In a second embodiment illustrated in FIG. 13, a small air intake fan 77 is provided on the inner wall of the cover 71 adjacent to the rear and lower portion of the printing shuttle 5 and a small air discharge fan 79 is provided on the outer wall of the cover 71 adjacent to the front and upper portion of the printing shuttle 5, respectively, in order to positively produce an air flow across the printing shuttle 5. With this arrangement, the hot air in the vicinity of the print head portion can be effectively discharged to efficiently cool the printer.

Moreover, it is possible to provide a large air discharge fan 81 in a discharge port provided at the lower portion of the back side of the apparatus body, in addition to the fan 79. The fan 81 ensures that the hot air discharged from the cover 71 is smoothly and completely discharged from the apparatus without remaining in the apparatus or being returned into the cover. It is preferable that an existing plate which constitutes a paper feeding guide 83 is adapted to inexpensively, form an air duct structure 85 so that a smooth air flow from the small air discharge fan 79 of the cover 71 to the large air discharge fan 81 can be obtained. It goes without saying that the duct structure 85 can be dispensed with if an air passage for a smooth air flow is established in the apparatus. Alternatively, it is possible to provide an independent duct structure without employing the plate 83.

As can be understood from the above discussion, according to the present invention, since the printing shuttle and the balancing shuttle are arranged so that the centers of gravity thereof are located as close as possible, not only can the vibration of the printer be dramatically reduced, but also the printer can be made small and light. In addition to the foregoing, according to the present invention, the heat generating elements can be effectively cooled, thus resulting in a realization of a high-speed printer.

What is claimed is:

1. A dot-matrix line printer comprising:

a printing shuttle which reciprocally moves to carry out a printing operation, and a balancing shuttle which moves in a direction opposite to the direction of the movement of the printing shuttle, wherein a cross section of the printing shuttle perpendicular to the direction of movement is elongated in a first direction and a cross section of the balancing shuttle perpendicular to the direction of movement is elongated in a second direction, different from said first direction, and wherein the balancing shuttle is at least partly inserted in the second direction into the printing shuttle so as not to interfere with the latter upon printing, so that the center of gravity of the balancing shuttle is located as close to the center of gravity of the printing shuttle as possible.

2. A dot-matrix line printer according to claim 1, wherein the printing shuttle and the balancing shuttle are arranged to form a generally T-shape in cross-section.

3. A dot-matrix line printer according to claim 1, wherein the printing shuttle and the balancing shuttle are arranged to form a generally cross-shape in cross section.

4. A dot-matrix line printer according to claim 1, wherein the printing shuttle and the balancing shuttle have at least one common shaft along and on which they move.

* * * * *